US009223259B2

(12) United States Patent
Hiroki et al.

(10) Patent No.: US 9,223,259 B2
(45) Date of Patent: Dec. 29, 2015

(54) FIXING DEVICE AND IMAGE FORMING APPARATUS

(71) Applicant: TOSHIBA TEC KABUSHIKI KAISHA, Shinagawa-ku, Tokyo (JP)

(72) Inventors: Masashi Hiroki, Kanagawa (JP); Hiroyuki Ishikawa, Shizukoa (JP); Kazuhiro Hara, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/461,521

(22) Filed: Aug. 18, 2014

(65) Prior Publication Data

US 2015/0071667 A1 Mar. 12, 2015

(30) Foreign Application Priority Data

Sep. 10, 2013 (JP) ..... 2013-187564

(51) Int. Cl.
*G03G 15/20* (2006.01)
*G03G 15/00* (2006.01)

(52) U.S. Cl.
CPC ..... *G03G 15/2014* (2013.01); *G03G 15/657* (2013.01); *G03G 2215/2009* (2013.01); *G03G 2215/2045* (2013.01)

(58) Field of Classification Search
CPC ..... G03G 15/2089; G03G 2215/2045
See application file for complete search history.

(56) References Cited

U.S. PATENT DOCUMENTS

| | | | | |
|---|---|---|---|---|
| 6,892,038 | B2 * | 5/2005 | Fukutani | 399/68 |
| 7,319,838 | B2 * | 1/2008 | Baba et al. | 399/323 |
| 7,426,353 | B1 * | 9/2008 | Sakakibara | 399/68 |
| 8,086,159 | B2 | 12/2011 | Shinshi | |
| 2013/0051831 | A1 * | 2/2013 | Shinagawa et al. | 399/69 |

* cited by examiner

*Primary Examiner* — Clayton E Laballe
*Assistant Examiner* — Leon W Rhodes, Jr.
(74) *Attorney, Agent, or Firm* — Amin, Turocy & Watson, LLP

(57) ABSTRACT

According to one embodiment, a fixing device includes a fixing section including a fixing belt laid over a plurality of supporting rollers and an endless rotating section that forms a nip between the rotating section and the fixing belt, the fixing section being configured to nip and carry a recording medium in the nip, and a control section configured to control the fixing section at first fixing speed while a leading end of the recording medium is passing at least a part of the nip and control the fixing section at second fixing speed higher than the first fixing speed after controlling the fixing section at the first fixing speed.

7 Claims, 5 Drawing Sheets

FIXING DEVICE AND IMAGE FORMING APPARATUS

CROSS-REFERENCE TO RELATED APPLICATION

This application is based upon and claims the benefit of priority from Japanese Patent Application No. 2013-187564, filed Sep. 10, 2013, the entire contents of which are incorporated herein by reference.

FIELD

Embodiments described herein relate generally to a fixing device that nips and carries a sheet and pressurizes and heats a toner image to fix the toner image to the sheet and an image forming apparatus including the fixing device.

BACKGROUND

There is a fixing device in which a fixing belt laid over a plurality of rollers including a pressurizing roller is wound around a heat roller to secure a large nip width between the heat roller and the fixing belt. However, in the fixing device including the fixing belt, a shock is caused in a sheet by speed fluctuation that occurs when the sheet enters a pressurizing section in which the pressurizing roller is pressed against the heat roller. If the shock in the sheet caused when the sheet enters the pressurizing section is propagated to a transfer section, it is likely that a toner image being transferred is disturbed and image quality is deteriorated.

Therefore, there is a technique for setting fixing speed low compared with transfer speed, bending the sheet between the transfer section and the fixing device, and preventing the toner image from being disturbed when the sheet enters the pressurizing section. However, if a bending amount of the sheet between the transfer section and the fixing device increases, it is likely that the sheet comes into contact with a structure present around the sheet and disturbs the toner image.

The related art is disclosed in JP-A-11-45025.

BRIEF DESCRIPTION OF THE DRAWINGS

FIGS. 5A to 5C are schematic explanatory diagrams showing the behavior of the sheet that passes through the transfer roller and the fixing device in the embodiment, wherein FIG. 5A shows the behavior of the sheet that occurs before a sheet leading end reaches the fixing device, FIG. 5B shows the behavior of the sheet while the sheet leading end is passing through a nip, and FIG. 5C shows the behavior of the sheet that occurs after the sheet leading end passes through the nip;

DETAILED DESCRIPTION

It is an object of an embodiment to provide a fixing device and an image forming apparatus that prevent disturbance of a toner image that occurs when a sheet enters a pressurizing section of a nip and prevent the sheet bent between a transfer section and the fixing device from coming into contact with a structure present around the sheet to obtain satisfactory image quality.

To attain the object, a fixing device in an embodiment includes: a fixing section including a fixing belt laid over a plurality of supporting rollers and an endless rotating section that forms a nip between the rotating section and the fixing belt, the fixing section being configured to nip and carry a recording medium in the nip; and a control section configured to control the fixing section at first fixing speed while a leading end of the recording medium is passing at least a part of the nip and control the fixing section at second fixing speed higher than the first fixing speed after controlling the fixing section at the first fixing speed.

Figure 1:
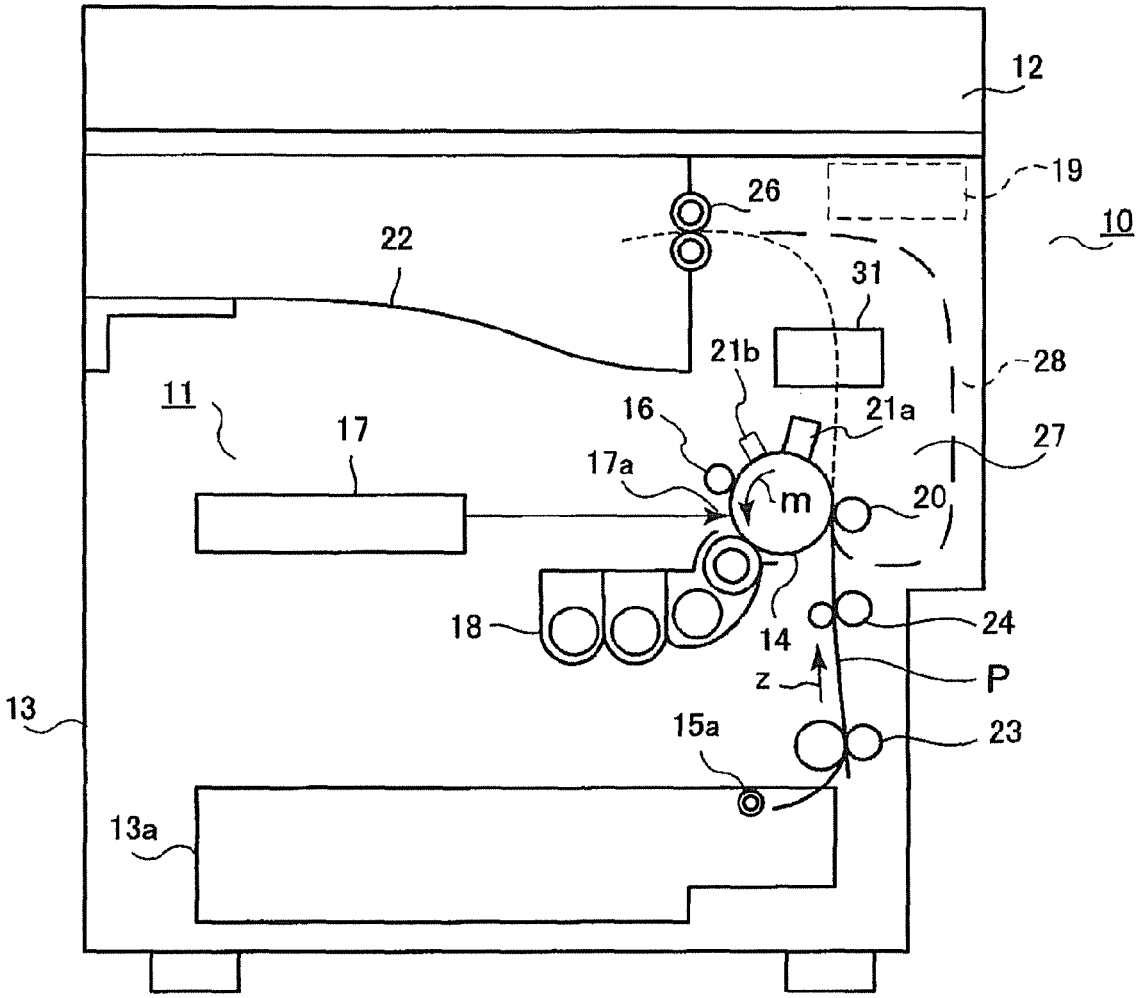
FIG. 1 is a schematic configuration diagram showing an MFP in an embodiment.

An embodiment is explained below with reference to FIGS. 1 to 10. FIG. 1 is a schematic configuration diagram showing an MFP (Multi Function Peripheral) 10, which is an example of an image forming apparatus in the embodiment. The MFP 10 includes a printer section 11, which is an image forming section. The MFP 10 includes a scanner section 12, a paper feeding section 13, an operation panel 19, and a paper discharge section 22. The scanner section 12 reads a document image for forming an image in the printer section 11. The paper feeding section 13 includes a paper feeding roller 15*a* and a paper feeding cassette 13*a*. The paper feeding cassette 13*a* is capable of feeding an unused sheet and a reuse sheet (a sheet on which an image is erased by decoloring processing) as recording media. For example, the operation panel 19 receives an input by a user or performs display for the user.

The printer section 11 includes, around a photoconductive drum 14 that rotates in an arrow m direction, an electrifying charger 16, an irradiation position 17*a* of a laser beam 17 by a laser exposing device 17, a developing device 18, a transfer roller 20, a cleaner 21*a*, and a charge removing LED 21*b*. The photoconductive drum 14 includes an organic photoreceptor (OPC) on the surface of a supporting member having a size of, for example, ϕ30 mm. The photoconductive drum 14 is driven at process conveyance speed V0. For example, the electrifying charger 16 uniformly charges the photoconductive drum 14 at −750 V. The laser exposing device 17 irradiates, on the charged photoconductive drum 14, the laser beam 17*a* based on image data output from the scanner section 12 or the like and forms an electrostatic latent image on the photoconductive drum 14.

The developing device 18 uses a two-component developer, which is a mixture of toner and a magnetic carrier. The developing device 18 forms, with a development bias of about −550 V, a toner image from the electrostatic latent image on the photoconductive drum 14 according to reversal development. The transfer roller 20 transfers the toner image formed on the photoconductive drum 14 onto a sheet P, which is a recording medium, at the process conveyance speed V0, which is transfer speed.

The printer section 11 includes a fixing device 31, which is a fixing section, between the photoconductive drum 14 and the paper discharge section 22. The MFP 10 includes a conveying section 27 that conveys the sheet P from the paper feeding section 13 to the paper discharge section 22 through the photoconductive drum 14 and the fixing device 31.

The conveying section 27 includes a conveying roller 23, a registration roller pair 24 that conveys the sheet P to between the photoconductive drum 14 and the transfer roller in synchronization with the toner image on the photoconductive drum 14, and a paper discharge roller 26 that discharges the sheet P to the paper discharge section 22 after the toner image is fixed on the sheet P. The printer section 11 includes a reversal conveyance section 28 downstream of the fixing device 31. If duplex printing is performed, the reversal conveyance section 28 reversely conveys the sheet P in the direction of the registration roller pair 24.

The MFP 10 transfers, with these components, the toner image on the photoconductive drum 14 onto the sheet P fed from the paper feeding section 13. After the toner image is fixed on the sheet P by the fixing device 31, the MFP 10 discharges the print-completed sheet P to the paper discharge section 22. The image forming apparatus is not limited to the configuration explained above. The image forming apparatus may include a plurality of printer sections and a plurality of paper feeding cassettes. For example, the image forming apparatus may form an image using decolorable toner that can be decolored by being heated at a predetermined temperature. The image forming apparatus may include a plurality of printer sections including a printer section that uses the decolorable toner and a printer section that uses non-decolorable toner.

Figure 2:
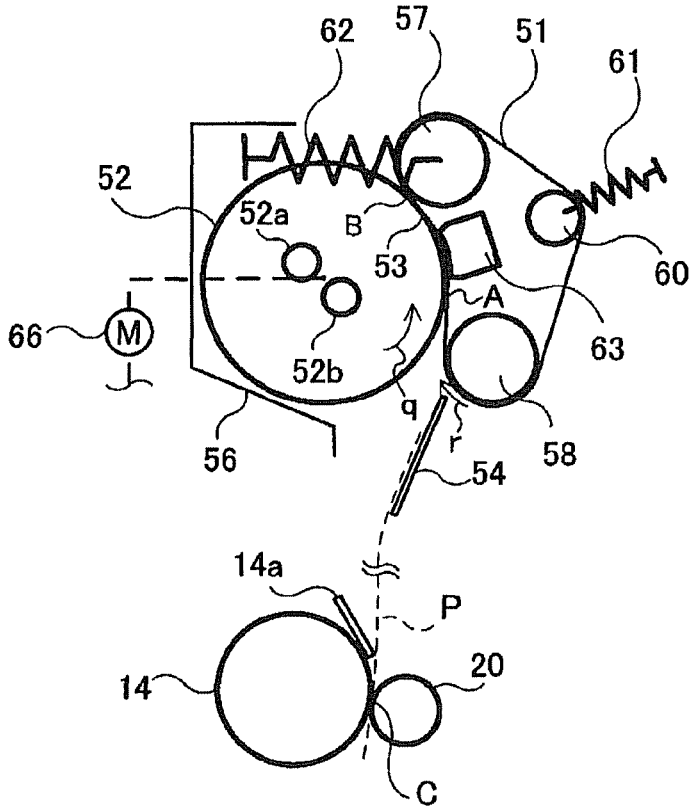
FIG. 2 is a schematic configuration diagram showing a fixing device in the embodiment.

The fixing device 31 is explained in detail. The fixing device 31 includes, as shown in FIG. 2, for example, a fixing belt 51 and a heat roller 52, which is an endless rotating section. In the fixing device 31, a part of the fixing belt 51 winds around the heat roller 52 to form a nip 53. The fixing device 31 nips the sheet P in the nip 53 and carries the sheet P and heats and pressurizes the toner image to fix the toner image on the sheet P. The fixing device 31 includes an inlet guide 54 that leads the sheet P in the direction of the nip 53. The fixing device 31 includes a case 56 that prevents, for example, if the sheet P is deformed, the sheet P from moving in the opposite direction of the rotation of the heat roller 52 to cause a paper jam.

The surface of the fixing belt 51 formed by laminating a rubber layer on a base material such as polyimide (PI) resin or nickel (Ni) is coated with fluorocarbon resin. The fixing belt 51 is laid over a plurality of supporting rollers, i.e., a pressurizing and supporting roller 57, an auxiliary roller 58, and a tension roller 60. The tension roller 60 pulls the fixing belt 51 at fixed tension with a tension applying spring 61 and adjusts the distance between the auxiliary roller 58 and the pressurizing and supporting roller 57.

The pressurizing and supporting roller 57 is pressurized in the direction of the heat roller 52 by a pressurizing spring 62. The fixing belt 51 includes, on the inner side, a nip pad 63 that brings the fixing belt 51 into contact with the heat roller 52. The fixing belt 51 winds around the heat roller 52 and forms the wide nip 53 from a nip entrance A to a nip exit B. At the nip exit B, the pressurizing and supporting roller 57 is pressed against the heat roller 52 and the pressure of the nip 53 increases.

The heat roller 52 is formed by, for example, coating the surface of a hollow cylindrical cylinder made of iron with a release layer made of PTFE (polytetrafluoroethylene) or the like. The heat roller 52 includes halogen lamps 52*a* and 52*b* on a hollow inside. The heat roller 52 is heated from the inside by radiation heat. The halogen lamps 52*a* and 52*b* are controlled to be turned on and off to set the heat roller 52 to a predetermined fixing temperature. The heat roller 52 may generate heat using an IH heater rather than the lamps.

The fixing device 31 rotates the heat roller 52 in an arrow q direction with, for example, a DC brushless motor 66 of an outer rotor type. The fixing belt 51 rotates in an arrow r direction following the heat roller 52. The fixing device 31 may drive the fixing belt 51 and cause the heat roller 52 to follow the fixing belt 51. Alternatively, the fixing device 31 may drive each of the fixing belt 51 and the heat roller 52. Further, a driving source for the fixing belt 51, the heat roller 52, and the like is not limited to the DC brushless motor 66. A pulse motor or the like may be used.

The MFP 10 controls to drive the DC brushless motor 66 and controls sheet conveyance speed (fixing speed) in heating and pressurizing the toner image and fixing the toner image on the sheet P in the nip 53 of the fixing device 31.

Figure 3:
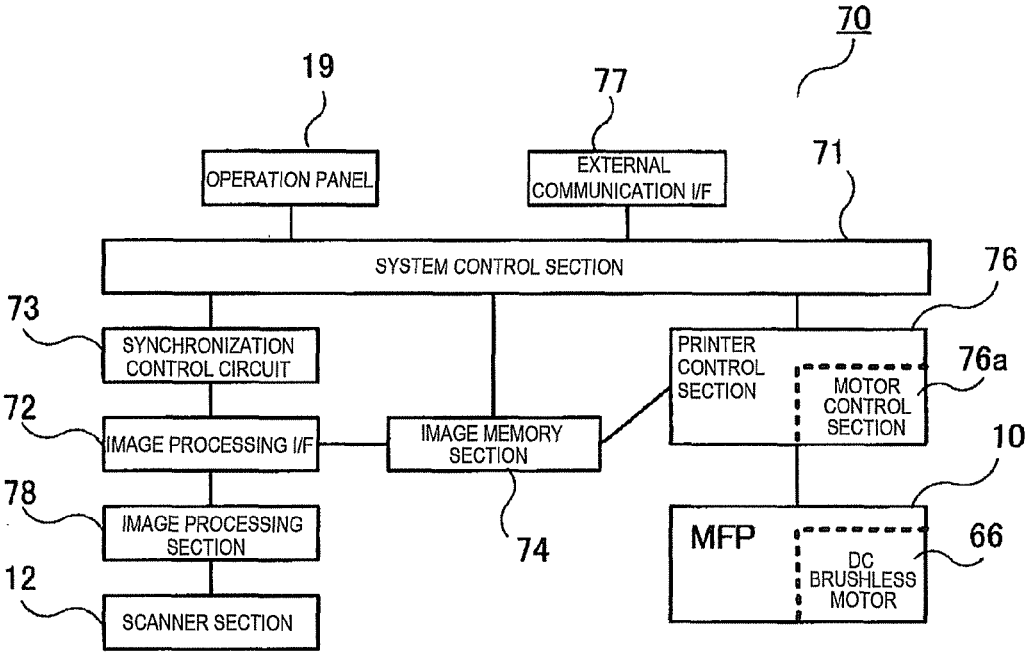
FIG. 3 is a schematic block diagram showing a control system that mainly controls a DC brushless motor of the MFP in the embodiment.
Figure 4:
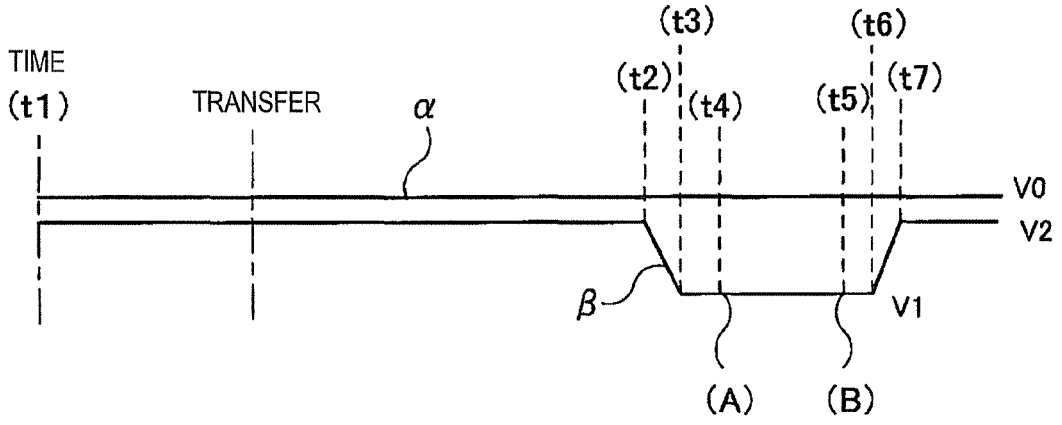
FIG. 4 is a timing chart showing conveyance of a sheet by a transfer roller and conveyance of the sheet by the fixing device.

A control system 70 that mainly controls the DC brushless motor 66 of the MFP 10 is explained with reference to a block diagram of FIG. 3. The control system 70 includes, for example, a system control section 71 that controls the entire MFP 10, an image processing I/F 72, a synchronization control circuit 73, an image memory section 74, a printer control section 76, which is a control section, an operation panel 19, an external communication I/F 77, an image processing section 78, a scanner section 12, and the MFP 10 including the DC brushless motor 66. The printer control section 76 includes a motor control section 76*a* that controls the speed of the DC brushless motor 66 or timing for switching the speed.

The system control section 71 is connected to the synchronization control circuit 73, the image memory section 74, the printer control section 76, the operation panel 19, and the external communication I/F 77. The image processing I/F 72 is connected to the synchronization control circuit 73, the image memory section 74, and the image processing section 78. The image processing section 78 is connected to the scanner section 12. The image memory section 74 is connected to the printer control section 76 besides the system control section 71 and the image processing I/F 72.

The printer control section 76 is connected to the system control section 71 and the MFP 10. The printer control section 76 controls the MFP 10, controls the speed of the brushless motor 66 of the fixing device 31, and controls timing for switching the speed of the DC brushless motor 66.

Fixing speed of the fixing device 31 driven by the DC brushless motor 66 controlled by the printer control section 76 is explained. As indicated by a solid line α shown in FIG. 4, while a print image is formed on the sheet P, the registration roller pair 24, the photoconductive drum 14, and the transfer roller 20 are driven at the fixed process conveyance speed V0. On the other hand, sheet conveyance speed of the fixing device 31 fluctuates as indicated by a solid line β according to the control of the DC brushless motor 66 by the printer control section 76.

At time (t1) when the leading end of the sheet P reaches the registration roller pair 24, the DC brushless motor 66 drives the heat roller 52 at speed V2, which is second fixing speed, lower than the process conveyance speed V0 (V0>V2). A ratio of reduction of V2 to V0 is not limited. However, V2 is reduced by, for example, about 0.1% to 0.9%.

At time (t2) before the leading end of the sheet P reaches the nip entrance A of the fixing device 31, the DC brushless motor 66 starts driving for reducing the speed of the heat roller 52 to speed V1, which is first fixing speed. The speed of the heat roller 52 gradually decreases and reaches the speed V1 at time (t3) before time (t4) when the leading end of the sheet P reaches the nip entrance A of the fixing device 31.

The sheet P enters the nip exit B at time (t5). The DC brushless motor 66 starts driving for increasing the speed of the heat roller 52 at time (t6) when the leading end of the sheet P passes through the nip exit B of the fixing device 31. The speed of the heat roller 52 gradually increases and returns to the speed V2 at time (t7).

When the speed of the fixing device 31 during the passage of the leading end of the sheet P through at least a part of the nip 53 is represented as V1 and the speed of the fixing device 31 during the presence of the leading end of the sheet P in a conveyance region other than the nip 53 is represented as V2, V2 is larger than V1 (V2>V1). A speed difference between the speed V1 and the speed V2 is not limited. The speed V1 is lower than the process conveyance speed V0 of the MFP 10 (V1<V0). A ratio of reduction of the speed V1 to the process conveyance speed V0 is not limited. However, the speed V1 is reduced by, for example, about 1.0% to 10.0%.

Figure 5A:
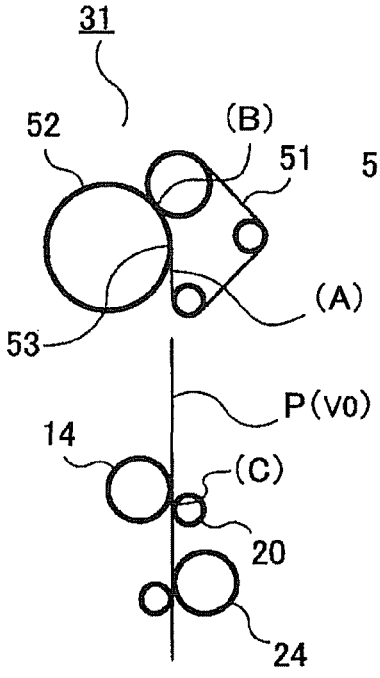
Figure 5B:
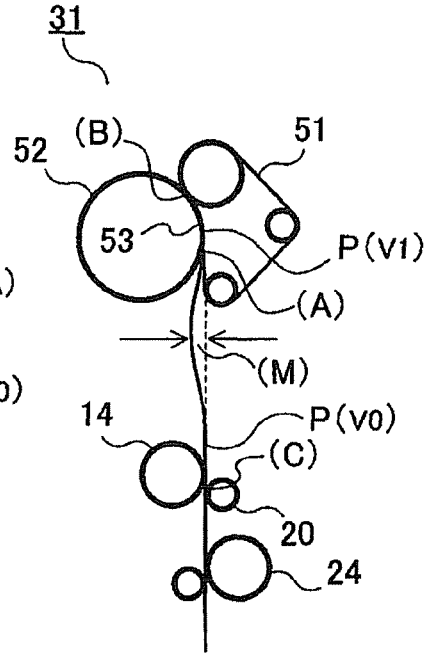

Before the leading end of the sheet P reaches the fixing device 31, as shown in FIG. 5A, the sheet P is conveyed in the direction of the fixing device 31 at the process conveyance speed V0 by the photoconductive drum 14 and the transfer roller 20. When the leading end of the sheet P reaches the nip entrance A, the photoconductive drum 14 and the transfer roller 20 convey the sheet P at the process conveyance speed V0. On the other hand, the fixing device 31 conveys the sheet P at the speed V1. Since V1<V0, as shown in FIG. 5B, the sheet P causes a bend between a transfer position C and the nip entrance A.

A bending amount (M) of the sheet P between the transfer position C and the nip entrance A gradually increases while the leading end of the sheet P passes through the nip 53. When the leading end of the sheet P passes through the nip exit B, the fixing device 31 increases the conveyance speed of the sheet P to the speed V2.

Figure 5C:
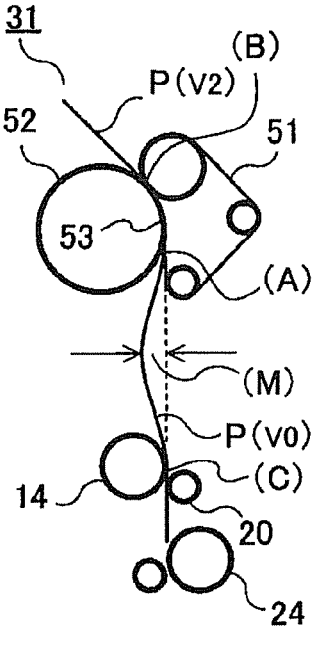

As shown in FIG. 5C, the bending amount (M) of the sheet P further increases between the transfer position C and the nip entrance A. However, since V0>V2>V1, an increase in the bending amount (M) in FIG. 5C after the passage of the leading end of the sheet P through the nip exit B is small compared with an increase in the bending amount (M) in FIG. 5B during the passage of the leading end of the sheet P through the nip 53.

Figure 6:
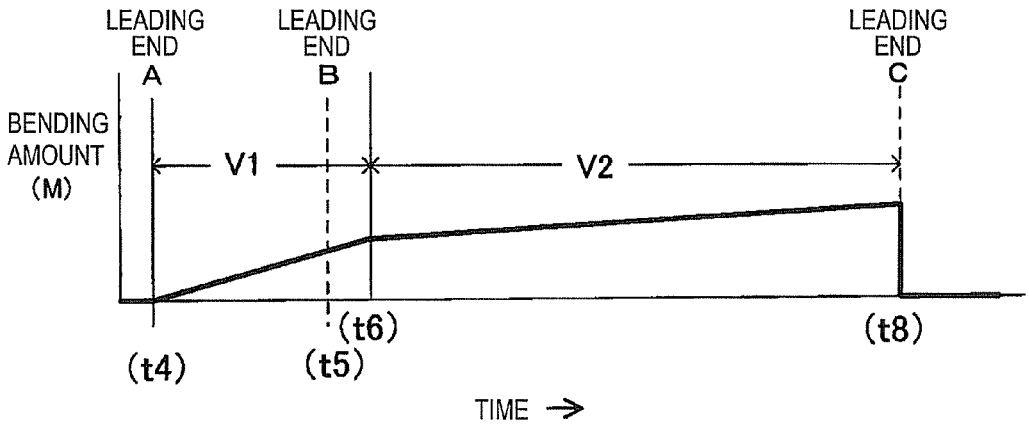
FIG. 6 is a graph showing a bending amount of the sheet between the transfer roller and the fixing device in the embodiment.

As shown in FIG. 6, after the leading end of the sheet P reaches the nip entrance A of the fixing device 31 at time (t4), the bending amount (M) increases in proportion to time at a gradient corresponding to a speed difference between the speed V1 of the fixing device 31 and the process conveyance speed V0. When the speed of the fixing device 31 is increased at time (t6) and reaches the speed V2 at time (t7), the speed difference between the speed V2 and the process conveyance speed V0 decreases. The increase in the bending amount (M) is reduced between time (t6) and time (t8) when the trailing end of the sheet P leaves the transfer position C. The bending amount (M) of the sheet P between the transfer position C and the nip entrance A is not so large. Therefore, it is possible to prevent a bent portion of the sheet P from coming into contact with the case 56 or a structure present around the sheet P such as a peeling claw 14*a* around the photoconductive drum 14.

When printing is started in the MFP 10, the printer control section 76 controls the printer section 11 and forms a toner image on the photoconductive drum 14. The printer control section 76 controls the printer section 11 and transfers, with the transfer roller 20, a toner image on the photoconductive drum 14 onto the sheet P at the process conveyance speed V0. The printer control section 76 controls the printer section 11 and conveys the sheet P, on which the toner image is transferred, to near the nip entrance A.

The motor control section 76*a* controls the DC brushless motor 66 to set the fixing speed to the speed V2 at time (t1) when the sheet P reaches the registration roller pair 24. The motor control section 76*a* controls the DC brushless motor 66 to set the fixing speed to the speed V1 at time (t2) when the sheet P reaches near the nip entrance A. The sheet P enters the nip entrance A at the process conveyance speed V0. The sheet P is conveyed at the speed V1 when the toner image is fixed on the sheet P. The sheet P is conveyed at the process conveyance speed V0 when the toner image is transferred onto the sheet P. Therefore, as shown in FIG. 5B, the sheet P causes a bend between the transfer roller 20 and the fixing device 31.

The bending amount (M) between the transfer roller 20 and the fixing device 31 increases according to a speed difference between the speed V1 and the process conveyance speed V0 until the leading end of the sheet P reaches the nip exit B. When the leading end of the sheet P enters the nip exit B, where a nip pressure is large, at time (t5), conveyance speed of the leading end of the sheet P fluctuates. However, a shock due to the fluctuation in the conveyance speed of the sheet P is absorbed by the bend between the transfer roller 20 and the fixing device 31 and is not propagated to the position of the transfer roller 20.

In the position of the transfer roller 20, the sheet P does not cause vibration due to the speed fluctuation. A toner image is not disturbed during the transfer.

The motor control section 76*a* controls the DC brushless motor 66 to return the fixing speed to the speed V2 at time (t6) after the passage of the leading end of the sheet P through the nip exit B. The fixing speed of the sheet P returns to the speed V2 at time (t7). An increase in the bending amount (M) between the transfer roller 20 and the fixing device 31 after the return of the fixing speed to the speed V2 corresponds to the speed difference between the speed V2 and the process conveyance speed V0. If the speed V2 decreases by about 0.1% to 0.9% from the process conveyance speed V0, the speed difference between the speed V2 and the process conveyance speed V0 is extremely small. The sheet P does not cause a large bend between the transfer roller 20 and the fixing device 31 and does not come into contact with the case 56, the peeling claw 14*a*, or the like.

Since the DC brushless motor 66 is used for the rotation of the heat roller 52, even if the motor control section 76*a* switches the frequency of a clock signal at time (t2) or time (t6), the driving of the DC brushless motor 66 is not instantaneously changed. However, compared with, for example, a pulse motor, the DC brushless motor 66 has an advantage that heat generation or noise is suppressed.

According to the embodiment, before the sheet P passed through the transfer roller 20 reaches the nip entrance A, the speed of the fixing device 31 is reduced to the speed V1 lower than the process conveyance speed V0. After reaching the nip entrance A, the sheet P causes a bend between the transfer roller 20 and the fixing device 31. A shock caused in the sheet P by speed fluctuation when the sheet P enters the nip exit B, where the nip pressure is large, is absorbed by the bend and is not propagated to the position of the transfer roller 20. Irrespective of the shock caused at the leading end of the sheet P at the nip exit B, the sheet P does not vibrate in the position of the transfer roller 20. Therefore, a satisfactory transfer image is obtained.

According to the embodiment, the speed of the fixing device 31 is increased to the speed V2 when the leading end of the sheet P passes through the nip exit B. After the leading end of the sheet P passes through the nip exit B, an increase in the bending amount (M) of the sheet P between the transfer roller 20 and the fixing device 31 is extremely small. The bend between the transfer roller 20 and the fixing device 31 is not so large. Therefore, the bend of the sheet P is prevented from coming into contact with a structure present around the sheet P to disturb a toner image and a satisfactory image is obtained. It is possible to reduce a space for avoiding a bend formed between the transfer roller 20 and the fixing device 31. Therefore, it is possible to attain a reduction in the size of the MFP 10.

In the embodiment, a control method for the DC brushless motor 66 by the motor control section 76*a* may be any method. For example, if a speed difference in switching the fixing speed is large, in the DC brushless motor 66, speed tends to undershoot or overshoot because of the inertia of a rotor. In order to prevent the undershoot or the overshoot of the DC brushless motor 66, the motor control section 76*a* may switch the frequency of a control signal a plurality of times stepwise and switch the fixing speed.

In the embodiment, the level of the second fixing speed of the fixing device 31 during the presence of the leading end of the sheet P in a conveyance region other than the nip 53 is not limited. The second fixing speed only has to be speed in a range in which a transfer blur due to a shock of the sheet P in entering the nip exit B is prevented and the bending amount (M) between the transfer roller 20 and the fixing device 31 does not increase.

First Modification

Figure 7:
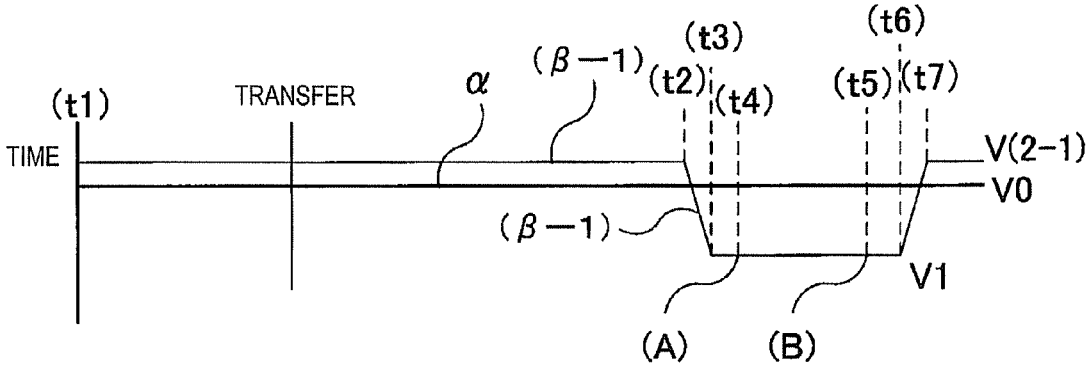
FIG. 7 is a timing chart showing conveyance of the sheet by the transfer roller and conveyance of the sheet by the fixing device in a first modification of the embodiment.

For example, as in a first modification indicated by a solid line (β-1) in FIG. 7, the second fixing speed may be set to speed V(2-1) higher than the process conveyance speed V0. If V(2-1)>V0, the motor control section 76*a* controls the DC brushless motor 66 to set the fixing speed to the speed V(2-1) at time (t1) when the sheet P reaches the registration roller pair 24. The motor control section 76*a* controls the fixing speed to the speed V1 at time (t2) when the sheet P reaches near the nip entrance A. After entering the nip entrance A, the sheet P causes a bend between the transfer roller 20 and the fixing device 31. The bending amount (M) between the transfer roller 20 and the fixing device 31 increases until the leading end of the sheet P reaches the nip exit B.

When the leading end of the sheet P enters the nip exit B at time (t4), a shock due to fluctuation in the conveyance speed of the sheet P is absorbed by the bend and is not propagated to the position of the transfer roller 20. After the leading end of the sheet P passes through the nip exit B, when the fixing speed is returned to the speed V(2-1) at time (t7), after time (t7), the bending amount (M) between the transfer roller 20 and the fixing device 31 decreases. Therefore, the bend of the sheet P does not come into contact with the peeling claw 14*a*, the case 56, or the like. It is possible to prevent disturbance of the toner image on the sheet P due to contact with a structure present around the sheet P.

However, after time (t7), if a tensile force of the sheet P by the fixing device 31 increases between the transfer roller 20 and the fixing device 31, the sheet P sometimes flaps when the trailing end of the sheet P leaves the position of the transfer roller 20. To prevent the sheet P from flapping to disturb an image, it is undesirable to increase a speed difference between the fixing speed V(2-1) and the process conveyance speed V0.

According to the first modification, as in the embodiment, the shock caused in the sheet P when the sheet P enters the nip exit B is absorbed by the bend and is not propagated to the position of the transfer roller 20. Therefore, it is possible to prevent the sheet P from vibrating during transfer and obtain a satisfactory transfer image. According to the first modification, after the leading end of the sheet P passes through the nip exit B, it is possible to reduce the bending amount (M) between the transfer roller 20 and the fixing device 31 and further reduce the size of the MFP 10.

Second Modification

Figure 8:
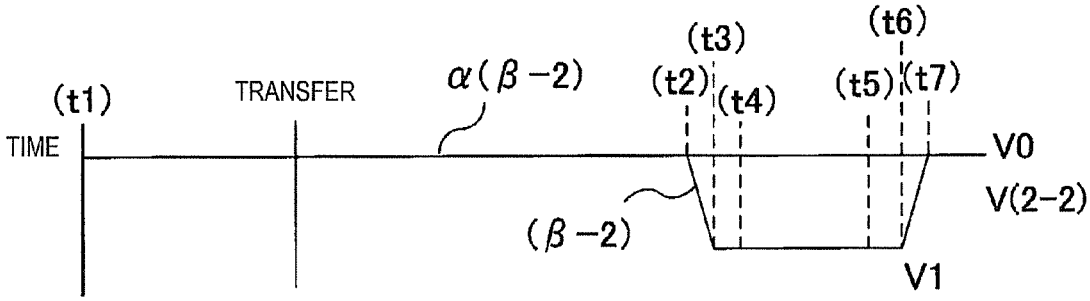
FIG. 8 is a timing chart showing conveyance of the sheet by the transfer roller and conveyance of the sheet by the fixing device in a second modification of the embodiment.

For example, as in a second modification indicated by a solid line (β-2) in FIG. 8, the second fixing speed may be set to speed V(2-2) equal to the process conveyance' speed V0. If V(2-2)=V0, the motor control section 76*a* sets the fixing speed to the speed V(2-2) at time (t1) when the sheet P reaches the registration roller pair 24. The motor control section 76*a* controls the fixing speed to the speed V1 at time (t2) when the sheet P reaches near the nip entrance A. After entering the nip entrance A, the sheet P causes a bend between the transfer roller 20 and the fixing device 31. The bending amount (M) increase until the sheet P reaches the nip exit B.

When the leading end of the sheet P enters the nip exit B at time (t5), a shock due to fluctuation in the conveyance speed of the sheet P is absorbed by the bend and is not propagated to the position of the transfer roller 20. After the leading end of the sheet P passes through the nip exit B, when driving the fixing speed to the speed V(2-2) at time (t6) is started, after time (t7), the bending amount (M) between the transfer roller 20 and the fixing device 31 does not increase and is kept fixed. Therefore, the bent sheet P does not come into contact with the peeling claw 14*a*, the case 56, or the like. It is possible to prevent disturbance of the toner image on the sheet P due to contact with a structure present around the sheet P.

According to the second modification, as in the embodiment, the shock caused in the sheet P when the sheet P enters the nip exit B is absorbed by the bend and is not propagated to the position of the transfer roller 20. Therefore, it is possible to prevent the sheet P from vibrating during transfer and obtain a satisfactory transfer image. According to the second modification, after the leading end of the sheet P passes through the nip exit B, it is possible to keep the bending amount (M) between the transfer roller 20 and the fixing device 31 fixed and further reduce the size of the MFP 10.

In the embodiment, timing for reducing the speed of the DC brushless motor 66 or timing for returning the speed by the motor control section 76*a* is not limited. When the sheet P enters the nip exit B, it is sufficient that a bend for absorbing a shock during the entrance can be formed between the transfer roller 20 and the fixing device 31 and an increase in the bending amount (M) can be suppressed.

Third Modification

Figure 9:
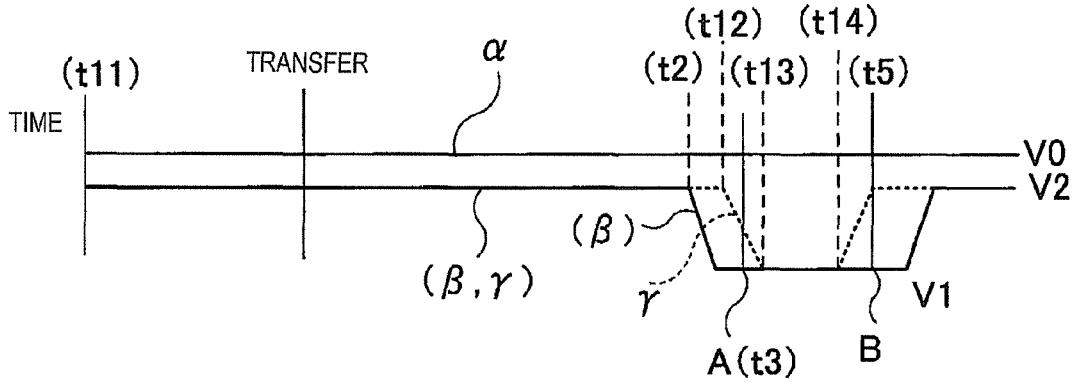
FIG. 9 is a timing chart showing conveyance of the sheet by the transfer roller and conveyance of the sheet by the fixing device in a third modification of the embodiment.

For example, as in a third modification shown in FIG. 9, the fixing speed may be switched while the leading end of the sheet P is passing through the nip 53. The registration roller pair 24, the photoconductive drum 14, and the transfer roller 20 are driven at the fixed process conveyance speed V0 as indicated by the solid line α. On the other hand, the sheet conveyance speed of the fixing device 31 is varied as indicated by a dotted line γ.

The DC brushless motor 66 starts driving for reducing the speed of the heat roller 52 at time (t12) later than time (t2) indicated by the solid line R and before the leading end of the sheet P reaches the nip entrance A of the fixing device 31. The speed of the heat roller 52 gradually decreases and reaches the speed V1 at time (t13) after time (t3) when the leading end of the sheet P reaches the nip entrance A of the fixing device 31.

The DC brushless motor 66 starts driving for increasing the speed of the heat roller 52 at time (t14) when the leading end of the sheet P is passing through the nip 53. The speed of the heat roller 52 gradually increases and returns to the speed V2 at time (t5) when the leading end of the sheet P passes through the nip exit B of the fixing device 31.

In the third modification, between time (t3) and time (t5), a bend is formed between the transfer roller 20 and the fixing device 31. Between time (t13) and time (t14), the bending amount (M) increases at a gradient corresponding to a speed difference between the speed V1 of the fixing device 31 and the process conveyance speed V0. As in the embodiment, the shock caused in the sheet P when the sheet P enters the nip exit B is absorbed by the bend and is not propagated to the position of the transfer roller 20. Therefore, it is possible to prevent the sheet P from vibrating during transfer and obtain a satisfactory transfer image. According to the third modification, time for reducing the speed of the fixing device 31 to the speed V1 is short. Therefore, it is possible to prevent the bending amount (M) between the transfer roller 20 and the fixing device 31 from increasing and reduce the size of the MFP 10.

Fourth Modification

Figure 10:
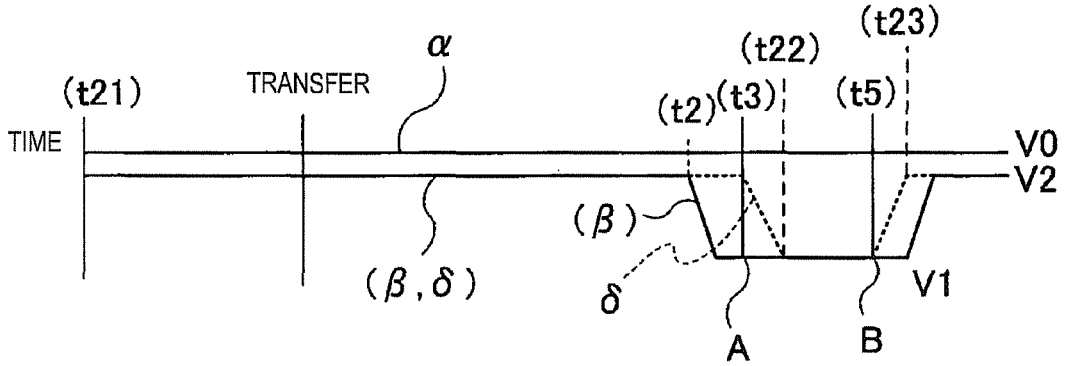
FIG. 10 is a timing chart showing conveyance of the sheet by the transfer roller and conveyance of the sheet by the fixing device in a fourth modification of the embodiment.

For example, as in a fourth modification shown in FIG. 10, timing for switching the fixing speed may be adjusted to timings when the leading end of the sheet P reaches the nip entrance A and the nip exit B. In the fourth modification, the registration roller pair 24, the photoconductive drum 14, and the transfer roller 20 are driven at the fixed process conveyance speed V0 as indicated by the solid line α. On the other hand, the sheet conveyance speed of the fixing device 31 is varied as indicated by a dotted line δ.

The DC brushless motor 66 starts driving for reducing the speed of the heat roller 52 at time (t3) when the leading end of the sheet P reaches the nip entrance A of the fixing device 31. The speed of the heat roller 52 gradually decreases and reaches the speed V1 at time (t22) when the leading end of the sheet P is present in the nip 53.

The DC brushless motor 66 starts driving for increasing the speed of the heat roller 52 at time (t5) when the leading end of the sheet P reaches the nip exit B. The speed of the heat roller 52 gradually increases and returns to the speed V2 at time (t23).

In the fourth modification, the fixing speed is switched at time (t3) when the leading end of the sheet P reaches the nip entrance A and time (t5) when the leading end of the sheet P reaches the nip exit B. A bend between the transfer roller 20 and the fixing device 31 is formed between time (t3) and time (t23). Between time (t22) and time (t5), the bending amount (M) increases at a gradient corresponding to the speed difference between the speed V1 of the fixing device 31 and the process conveyance speed V0. As in the embodiment, the shock caused in the sheet P when the sheet P enters the nip exit B is absorbed by the bend and is not propagated to the position of the transfer roller 20. Therefore, it is possible to prevent the sheet P from vibrating during transfer and obtain a satisfactory transfer image. According to the fourth modification, time for reducing the speed of the fixing device 31 to the speed V1 and fixing the toner image is short. Therefore, it is possible to prevent the bending amount (M) between the transfer roller 20 and the fixing device 31 from increasing and reduce the size of the MFP 10.

In the embodiment, timing for reducing the speed of the DC brushless motor 66 by the motor control section **76*a* may be either before or after the leading end of the sheet P enters the nip entrance A. Timing for increasing the speed of the DC brushless motor 66 by the motor control section 76*a*** may be either before or after the leading end of the sheet P passes through the nip exit B.

For example, in the case of continuous printing, if the speed of the DC brushless motor 66 is reduced before the leading end of the following sheet P enters the nip entrance A, the trailing end of the preceding sheet P sometimes does not pass through the nip exit B yet. If the fixing speed is varied while the preceding sheet P is already passed to the paper discharge roller 26, the reversal conveyance path 28, or the like downstream of the fixing device 31, control of the paper discharge roller 26 or the like is complicated. Therefore, in the case of the continuous printing, even if the leading end of the following sheet P already enters the nip entrance A, it is desirable to reduce the fixing speed of the following sheet P after the trailing end of the preceding sheet P passes through the nip exit B.

In the embodiment explained above, the control section normally controls the fixing section at the second fixing speed. However, the control by the control section is not limited to this. For example, the control section may normally control the fixing section at the first fixing speed and, only at timing when the recording medium leaves the nip exit, control the fixing section at the second speed higher than the first fixing speed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A fixing device comprising:

a fixing section including a fixing belt laid over a plurality of supporting rollers and an endless rotating section that forms a nip between the rotating section and the fixing belt, the fixing section being configured to nip and carry a recording medium in the nip; and a control section configured to control the fixing section at first fixing speed while a leading end of the recording medium is passing at least a part of the nip and control the fixing section to increase fixing speed higher than the first fixing speed immediately after the leading end of the recording medium passes through an exit of the nip.

2. The device according to claim 1, wherein the control section controls the fixing section to set the first fixing speed lower than a speed of the recording medium at an image transfer portion.

3. The device according to claim 1, wherein the plurality of supporting rollers include a pressurizing and supporting roller configured to pressurize the fixing belt against the endless rotating section downstream of the nip.

4. The device according to claim 1, wherein, if the fixing section continuously nips and carries recording media, the control section controls the fixing section to reduce fixing speed of a following recording medium to the first fixing speed after a preceding recording medium passes through the nip.

5. The device according to claim 1, wherein the control section switches the fixing section to the first fixing speed while the leading end of the recording medium is passing through the nip.

6. The device according to claim 1, wherein the control section switches the fixing section to the first fixing speed before the leading end of the recording medium enters the nip.

7. An image forming apparatus comprising:

an image forming section configured to form a toner image on a transfer medium;

a transfer section configured to transfer the toner image formed on the transfer medium onto a recording medium; and the fixing device according to any one of claims 1 to 6 configured to fix, on the recording medium, the toner image transferred onto the recording medium by the transfer section.

* * * * *

UNITED STATES PATENT AND TRADEMARK OFFICE

CERTIFICATE OF CORRECTION

PATENT NO. : 9,223,259 B2
APPLICATION NO. : 14/461521
DATED : December 29, 2015
INVENTOR(S) : Masashi Hiroki et al.

It is certified that error appears in the above-identified patent and that said Letters Patent is hereby corrected as shown below:

Title Page, column 1, line 6, item (72) Inventors:

Masashi Hiroki, Kanagawa (JP);
Hiroyuki Ishikawa, Shizukoa (JP);
Kazuhiro Hara, Shizuoka (JP)

It should read:

(72) Inventors:

Masashi Hiroki, Kanagawa (JP);
Hiroyuki Ishikawa, Shizuoka (JP);
Kazuhiro Hara, Shizuoka (JP)

Signed and Sealed this
Nineteenth Day of July, 2016

Michelle K. Lee

Michelle K. Lee
*Director of the United States Patent and Trademark Office*